United States Patent [19]

Work

[11] 4,186,973

[45] Feb. 5, 1980

[54] DECK-MOUNTED SHAFT BUSHING

[75] Inventor: John T. Work, Anaheim, Calif.

[73] Assignee: BJ-Hughes Inc., Long Beach, Calif.

[21] Appl. No.: 927,868

[22] Filed: Jul. 25, 1978

Related U.S. Application Data

[63] Continuation of Ser. No. 773,082, Feb. 28, 1977, abandoned.

[51] Int. Cl.[2] ..... F16C 21/00

[52] U.S. Cl. ..... 308/3.9; 175/220; 308/4 A; 308/238

[58] Field of Search ..... 175/220; 64/23.5; 308/3.9, 4 A, 4 R, 238, 3 R

[56] References Cited

U.S. PATENT DOCUMENTS

| | | | |
|---|---|---|---|
| 2,259,460 | 10/1941 | Dexter | 64/23.5 |
| 2,897,016 | 7/1959 | Baker | 308/4 A |
| 3,951,470 | 4/1976 | McLean | 308/3.9 |

*Primary Examiner*—Douglas C. Butler

*Attorney, Agent, or Firm*—Paul A. Weilein

[57] ABSTRACT

A guide bushing mountable in a supporting sleeve in the deck of a blast hole drill for guiding a drill string extending through the sleeve, the bushing having a tubular core providing a cylindrical axial bore adapted to receive and guide the drill string, the core having a flange by which it is supported in the supporting sleeve, and in which a resilient, elastomeric cushion mounted on the exterior of the core serves to cushion transverse movements of the bushing within the supporting sleeve. Preferably, the bushing is formed of two halves fastened together by hinges, so that it can be opened and laterally installed around the drill string.

18 Claims, 4 Drawing Figures

DECK-MOUNTED SHAFT BUSHING

This is a continuation of application Ser. No. 793,082, filed Feb. 28, 1977, now abandoned.

BACKGROUND OF THE INVENTION

1. Field of the Invention

This invention relates to a guide bushing for guiding a drill string of a blast hole drill, and more particularly to such a guide bushing that is mountable in the deck or table of the blast hole drill.

2. Description of the Prior Art

Heretofore, guide bushings of the foregoing character have been available to the industry. In one type, such guide bushings have been made entirely of metal and, hence, have been extremely noisy in operation and have transmitted excessive vibrations to the blast hole drill in which they have been installed. Although relatively inexpensive, such metal bushings have not had long service life, and have tended to rapidly wear the drill string.

U.S. Pat. No. 3,951,470 to McLean discloses a guide bushing for a blast hole drill that improves upon the prior metal bushing. This patented bushing employs ball bearings. It is much more costly than the prior metal bushing, yet it is not very quiet in operation, and is understood to have a relatively short service life.

SUMMARY OF THE INVENTION

Objects of the invention are to provide a guide bushing for guiding the drill string of a blast hole drill, the guide bushing being relatively simple in construction, and inexpensive to manufacture, yet exhibiting a long and useful service life while operating in a quiet manner, dampening vibrations set up by the rotating drill string.

In accordance with the invention, there is provided a guide bushing mountable in a supporting sleeve in the deck of a blast hole drill for guiding a drill string extending through the sleeve, said bushing comprising: rigid cylindrical tubular core means providing a cylindrical axial bore adapted to receive and guide the drill string, said core means adapted to be disposed in the sleeve and around the drill string; means for mounting said core means substantially coaxially in the sleeve whilst allowing relative transverse movements between said core means and the sleeve; and resilient, elastomeric cushion means mounted on the exterior of said core means and adapted to coact with the interior wall of the sleeve to cushion said relative transverse movements.

DESCRIPTION OF THE PREFERRED EMBODIMENT

Figure 1:
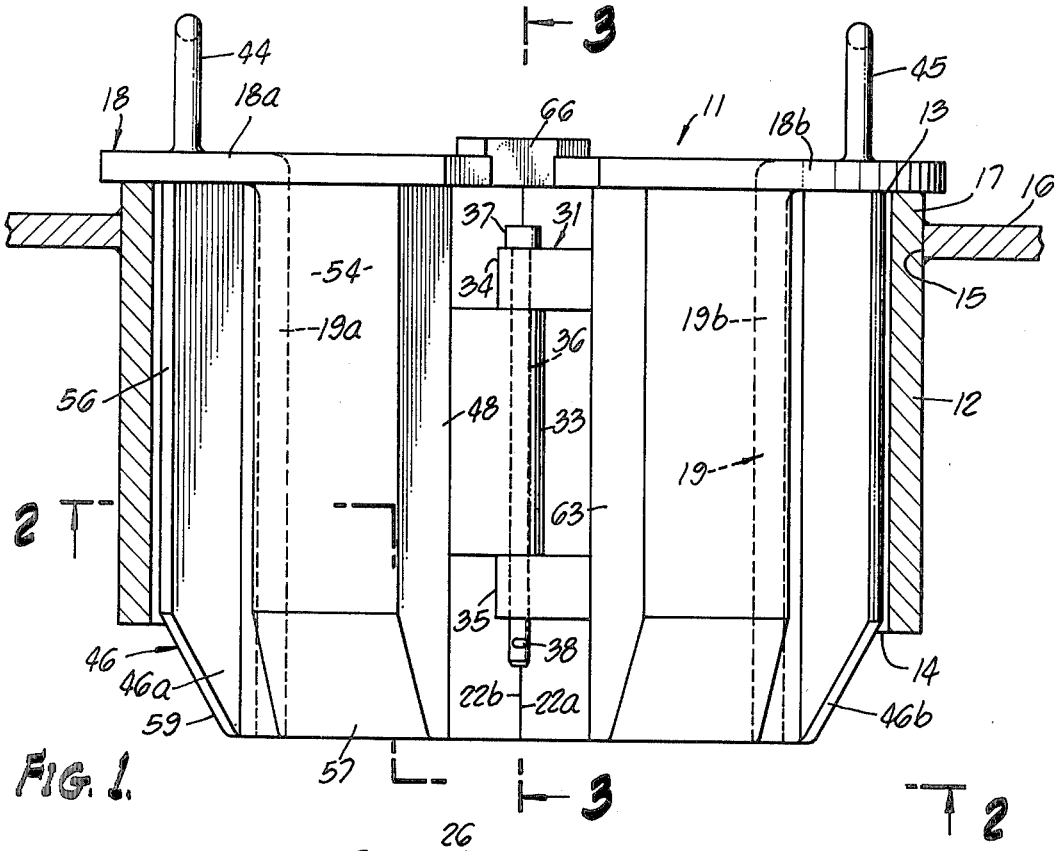
FIG. 1 is a vertical sectional view of a portion of the deck structure of a blast hole drill showing, in elevation, a guide bushing in accordance with the invention installed therein.
Figure 3:
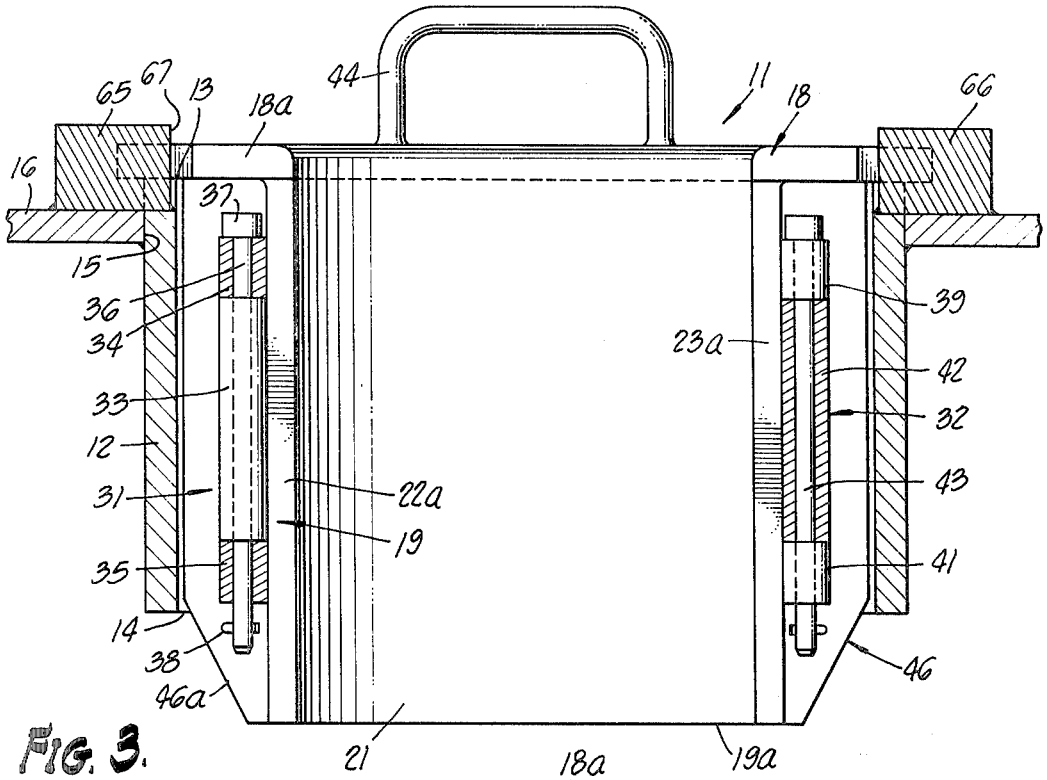
FIG. 3 is a sectional view taken along the line 3—3 of FIG. 1 looking in the direction of the arrows.
Figure 4:
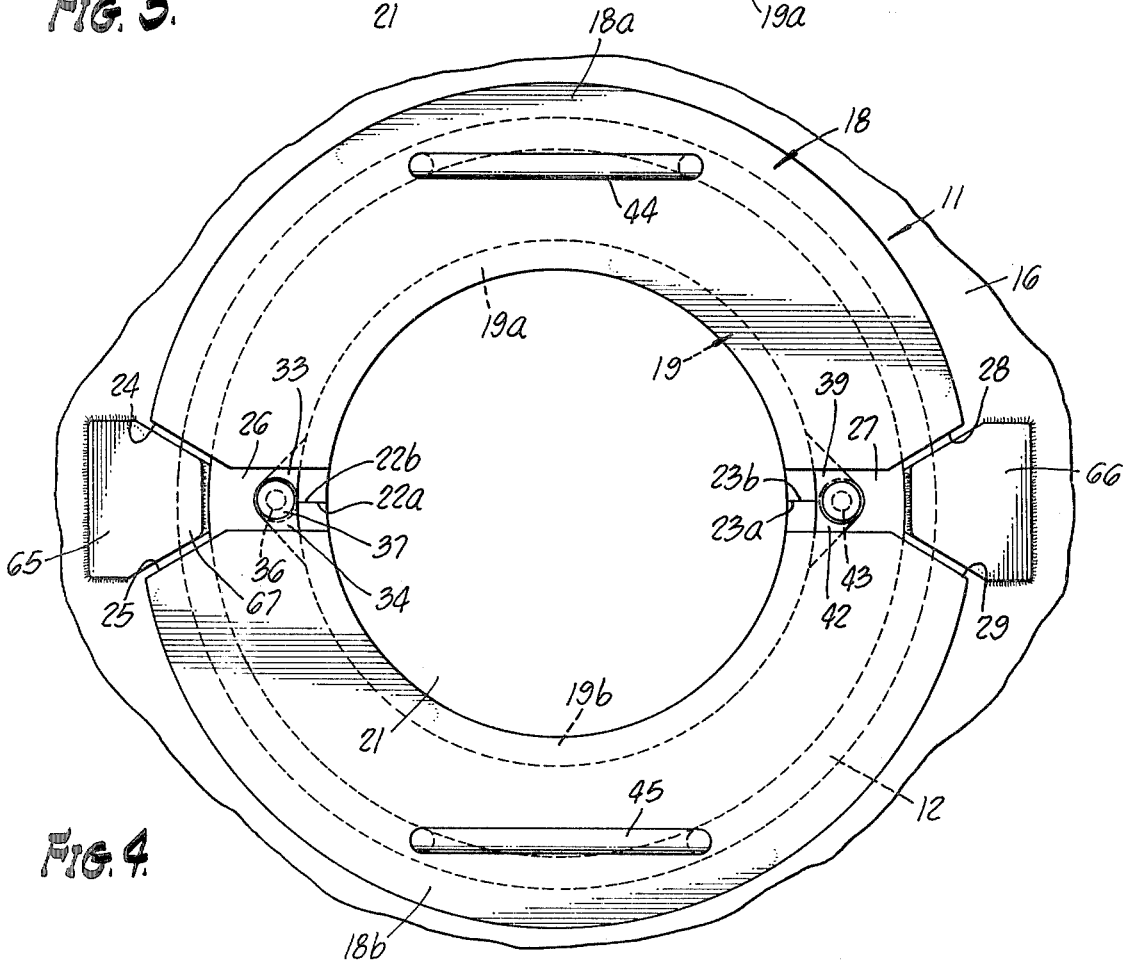
FIG. 4 is a plan view of the guide bushing and deck structure shown in FIG. 3.

Referring to the drawings, there is shown a guide bushing, designated by the general reference numeral 11, embodying the present invention. In FIGS. 1, 3 and 4, the guide bushing 11 is shown disposed in a vertical cylindrical sleeve 12, sometimes called a guide bushing bucket, the sleeve being open at the top 13 and at the bottom 14. The sleeve is welded into a circular opening 15 in the deck plate 16 of a blast hole drill, such as the blast hole drill disclosed in U.S. Pat. No. 3,944,300 to Learmont et al. The sleeve 12 projects slightly above the deck plate 16 and provides a rim 17 that extends above the deck plate 16. The guide bushing 11 has, at its top, outwardly extending flange means 18 that rest on the rim 17 to thereby support the guide bushing in the sleeve. Alternatively, the top 13 of sleeve 12 may be positioned flush with the top of the deck plate 16, in which case the flange means 18 will rest in part on the deck plate and in part on the rim 17.

Dependent from the flange means 18 is a rigid cylindrical tubular core means 19. This core means and the flange means 18 are made of metal, preferably iron or steel. The core means and flange means may be cast or fabricated, for example. Especially if cast, the core means and flange means may be monolithic.

A bore 21 within the core means provides a rotary shaft opening for loosely journalling and vertically guiding a drill string S, as shown in phantom lines in FIG. 1, and which may be embodied in a blast hole drill, such as that disclosed in the aforementioned McLean patent. In order to perform these functions efficaciously, the metal that forms the interior wall of the core means should have good bearing properties with respect to the metal of which the drill string is made.

In the preferred embodiment shown in the drawings, it is seen that the core means with its flange means is assembled from two identical half-pieces. One of the half-pieces has a core portion **19*a* and a flange portion 18*a*, and the other has a like core portion 19*b* and a like flange portion 18*b***.

The core portions of the half-pieces abut each other along pairs of opposed vertical faces, the respective abutting pairs of faces being located 180° apart. One of the pairs of faces consists of a face **22*a* on the core portion 19*a* and an abutting face 22*b* on the core portion 19*b*. The other of the pairs consists of a face 23*a* on the core portion 19*a* and an abutting face 23*b* on the core portion 19*b***.

As best seen in FIG. 4, the flange portion **18*a* has an end 24 and the flange portion 18*b* has an end 25 that are circumferentially spaced from each other to provide a notch 26 that extends radially and outwardly from the abutting faces 22*a*, 22*b*, and in alignment with them. A diametrically opposite notch 27 is provided between circumferentially separated other ends 28 and 29 of the flange portions 18*a* and 18*b***, respectively.

The previously mentioned half-pieces are joined together in assembled relation by suitable, oppositely disposed fastener means 31,32. These fastener means preferably take the form of hinges external to the core means 19. The hinge 31 has a central knuckle 33 on the core portion **19*a* and this knuckle is positioned intermediate an upper knuckle 34 on the core portion 19*b* and a lower knuckle 35 also on the core portion 19*b*. A hinge pin 36 is disposed in vertically aligned holes extending through the knuckles, the hinge pin having a head 37 at its upper end and a cotter key 38 at its lower end for retaining the hinge pin in the knuckles. As best seen in FIG. 4, the hinge pin 36 is aligned with the notch 26 so that it can be withdrawn from the knuckles upwardly through the notch after the cotter key 37** has been removed. The hinge pin, of course, can be reinserted into the knuckles through the notch. The hinge pin, being narrower than the notch, will easily pass through it.

The hinge 32 is identical to the hinge 31 described in the immediately preceding paragraph, but has its upper and lower knuckles 39,41 on the core portion 19*a* and its intermediate knuckle 42 on the core portion 19*b*. The hinge 32 has a hinge pin 43 that can be inserted into and withdrawn from the holes in the knuckles through the notch 27.

A pair of grips or handles 44,45 are welded or otherwise suitably affixed to the flange portions 18*a* and 18*b*, respectively, for use in manipulating the guide bushing.

Cushion means 46 are mounted on the exterior of the core means 19 and below the flange means 18. The cushion means are provided in two identical sections, section 46*a* being mounted on the core portion 19*a* and section 46*b* on the core portion 19*b*. The cushion means are formed of resilient material, preferably resilient elastomeric material such as natural or synthetic rubber composition having good resilience and shock absorbing qualities, and good abrasion resistance.

Figure 2:
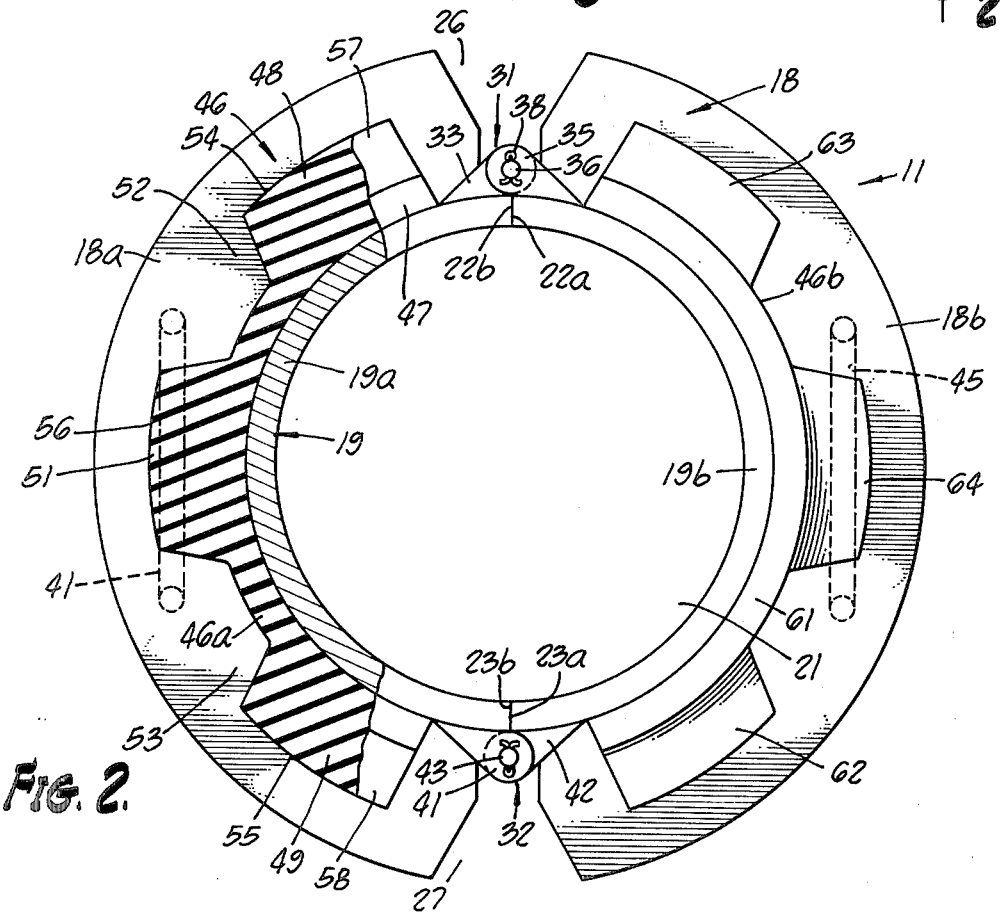
FIG. 2 is a partial sectional view taken along the line 2—2 of FIG. 1 looking in the direction of the arrows, with the deck structure omitted for the sake of clarity.

As best seen in FIG. 2, cushion section 46*a* has an inner portion 47 of uniform thickness that extends peripherally over the core portion 19*a* from the knuckle 33 in a counterclockwise direction to the knuckles 39 and 41. This inner portion 47 extends vertically from the bottom of the core portion 19*a* to the under side of the flange portion 18*a*. The inner portion 47 has radially projecting, vertical end ribs 48 and 49, and a radially projecting, vertical intermediate rib 51. The ribs are circumferentially spaced to provide flutes 52 and 53 between successive ribs.

The ribs 48, 49 and 51 have cylindrical lands 54, 55 and 56, respectively, that have identical radii and that extend downwardly from the tops of the ribs. The bottoms of the ribs are provided with chamfered surfaces 57, 58 and 59 that merge with the lands and with the bottom of the inner portion 47 of the cushion section 46*a*. The cushion section 46*a* may be, and preferably is, a unitary molding, cured in contact with and bonded to the outer surface of the core portion 19*a*.

The cushion section 46*b*, previously mentioned, is identical to the cushion section 46*a*, just described. It is molded, cured and bonded to the core portion 19*b*, and, together with the cushion section 46*a*, forms the cushion means 46 that substantially encircles the core means 19. The cushion section 46*b* has an inner cylindrical portion 61, and integral ribs 62,63,64.

It is seen from FIG. 2 that ribs 48,49,51, 62,63 and 64 have equal radii and project outwardly beyond the hinges 31 and 32. The hinge 31 is recessed in the space between the ribs 48 and 63, and the hinge 32 is recessed in the space between the ribs 49 and 62. Thus, the hinges are prevented by the ribs from contacting the sleeve 12, and are thereby protected from damage.

Referring to FIGS. 1, 3 and 4, stop blocks 65 and 66 are shown as being welded to the upper surface of the deck plate 16. The block 65 has a tapered nose portion 67 that extends into the notch 26 of the flange means. Similarly, the stop block 66 has a tapered nose portion that extends into the notch 27. The nose portions of the blocks fit loosely in the respective notches, but they do prevent the guide bushing 11 from turning in the sleeve 12 to any substantial extent.

The guide bushing may be installed around a drill string that extends through the sleeve 12 by removing one of the hinge pins 36 and 43 and swinging the two parts of the bushing on the other of the hinge pins so that the bushing is opened sufficiently to be passed laterally about the drill string. The two parts of the bushing are then closed around the drill string and locked by replacing the hinge pin that was removed.

The bushing fits loosely about the drill strings, and may be lowered into the sleeve 12 and positioned therein as shown in FIGS. 1, 3 and 4. In this position, the bushing journals the drill string as it rotates and guides it as it advances during drilling.

As the drill string rotates in the bushing, the bushing is free to move laterally in all directions, as permitted by the looseness of the fit between the stop blocks and the flange notches, but the lateral movements are cushioned and limited by the engagement of the lands of the resilient cushion means 46 with the interior of the sleeve 12. The resiliency of the cushion means substantially deadens the vibrations and noise of the drill string, and softens the shocks transmitted to the bore hole drill.

After coming out of the hole, the bushing 11 may be removed from the drill string by pulling one of the hinge pins, and swinging the halves of the bushing apart, allowing it to be removed laterally from around the drill string.

The preferred embodiment shown and described herein is merely examplary of the invention. In the light of the foregoing description and the drawings, changes and modifications will occur to those skilled in the art without departing from the spirit and scope of the invention as defined in the claims.

I claim:

1. A guide bushing mountable in a supporting sleeve for a guiding drill string extending through the sleeve, said bushing comprising:

rigid cylindrical tubular core means providing a cylindrical axial bore adapted to receive and guide the drill string, said core means adapted to be disposed in the sleeve and around the drill string;

means for mounting said core means substantially coaxially in the sleeve while allowing relative transverse movements between said core means and the sleeve, and being operative to prevent any substantial rotation of said core means while permitting unrestricted rotation of the drill string relative to said core means; and resilient, elastomeric cushion means mounted on the exterior of said core means and adapted to coact with the interior wall of the sleeve to cushion said relative transverse movements.

2. A guide bushing as defined in claim 1, wherein said rigid cylindrical tubular core means comprise two semi-cylindrical portions in end-to-end relation, and means for fastening said portions together.

3. A guide bushing as defined in claim 2, wherein said means for fastening said portions together comprise hinge means.

4. A guide bushing as defined in claim 2, wherein said means for fastening said portions together comprise longitudinally extending hinge means having removable hinge pins, said means for mounting said core means comprises flange means extending outwardly from said core means and having an outside diameter greater than the diameter of the sleeve, said flange means overlying said hinge pins, and openings in said flange means through which said hinge pins can be removed.

5. A guide bushing as defined in claim 4, wherein said resilient, elastomeric cushion means provides circumferentially spaced, longitudinal flutes alternating with circumferentially spaced, longitudinal ribs terminating in outwardly facing lands, and said means for fastening said portions together are recessed in said flutes.

6. A guide bushing as defined in claim 1, wherein said means for mounting said core means comprise flange means extending outwardly from said core means and having an outside diameter greater than the diameter of the sleeve.

7. A guide bushing as defined in claim 6, including stop means on said flange means and cooperable with a relatively fixed stop means for preventing rotation of said core means on its axis.

8. A guide bushing as defined in claim 1, wherein said resilient, elastomeric cushion means is bonded to and substantially surrounds the exterior of said core means and provides circumferentially spaced, longitudinal flutes alternating with circumferentially spaced, longitudinal ribs terminating in outwardly facing lands that are adapted to coact with the interior of the sleeve.

9. A guide bushing as set forth in claim 1, in which the cushion means extends along a substantial portion of the length of said sleeve.

10. A guide bushing as set forth in claim 1, in which the cushion means extends axially along a substantial length of the core means.

11. A deck-mounted guide bushing for a drill string of a blast hole drill structure, comprising:

a tubular core having a radially outwardly projecting mounting flange at its top end;

fixed means coacting with said flange for preventing any substantial rotational movement of said flange and said core; and a resilient cushion fixedly secured to the exterior of said core and extending downwardly from said flange, and said cushion having an outer periphery positioned radially inwardly with respect to the outer periphery of said flange.

12. A guide bushing as set forth in claim 11, in which said cushion is formed to provide a plurality of circumferentially spaced longitudinally extending radially outwardly projecting integrally formed ribs terminating in outwardly facing peripheral lands.

13. A guide bushing as set forth in claim 12, in which the ribs have inwardly extending bevelled bottom ends.

14. A guide bushing as set forth in claim 11, in which said core and cushion comprise a plurality of hinge-connected arcuate sections.

15. A guide bushing as set forth in claim 14, in which the cushion of each section is arcuate and comprises alternately spaced longitudinally extending flutes and ribs.

16. A guide bushing as set forth in claim 14, in which at least one hinge connection is releasable to permit hinged movement of said sections to an open position.

17. A guide bushing as set forth in claim 14, in which an upstanding hand grip is mounted on the flange of each of said sections.

18. A guide bushing mountable in a supporting sleeve for guiding a rotatable drill string extending through the sleeve, said bushing comprising:

rigid cylindrical tubular core means providing a cylindrical axial bore adapted to receive and guide the drill string, said core means adapted to be disposed in the sleeve and around the drill string;

means for mounting said core means substantially coaxially in the sleeve and retaining the same against any substantial rotation while allowing relative transverse movements between said core means and the sleeve; and resilient, elastomeric cushion means mounted on the exterior of said core means and extending substantially the length of said sleeve to coact with the interior wall of the sleeve to cushion said relative transverse movements generally throughout the length of said sleeve.

* * * * *